United States Patent [19]

Gellerstedt et al.

[11] 4,005,656

[45] Feb. 1, 1977

[54] DEVICE FOR A PYROTECHNICAL FLARE BODY COMPRISING A FLAME SPREADER FOR THE FLAME EMITTED BY THE FLARE BODY

[75] Inventors: Nils Göran Gellerstedt; Yngve Bertil Stradålen, both of Karlskoga, Sweden

[73] Assignee: AB Bofors, Bofors, Sweden

[22] Filed: June 9, 1975

[21] Appl. No.: 585,425

[30] Foreign Application Priority Data

June 27, 1974 Sweden ..... 7408464

[52] U.S. Cl. ..... 102/35.6; 102/6

[51] Int. Cl.[2] ..... F42B 4/12

[58] Field of Search ..... 102/35, 35.2, 35.4, 102/35.6, 6, 87; 89/1.5 R

[56] References Cited

UNITED STATES PATENTS

| | | | |
|---|---|---|---|
| 1,108,654 | 8/1914 | Ziegenfuss | 102/35.2 |
| 1,312,499 | 8/1919 | Holt | 102/35.4 X |
| 1,683,940 | 9/1928 | Wiley | 102/35 |
| 1,709,644 | 4/1929 | Wiley | 102/35.6 |
| 1,774,535 | 9/1930 | Wiley | 102/35 UX |
| 1,978,641 | 10/1934 | Martin | 102/35.6 X |
| 3,491,689 | 1/1970 | Francois | 102/35.6 |
| 3,893,396 | 7/1975 | Simmons | 102/35 |

*Primary Examiner*—David H. Brown
*Attorney, Agent, or Firm*—Pollock, Vande Sande & Priddy

[57] ABSTRACT

A projectile such as a bomb or rocket is provided with a flare section comprising an elongated cylindrical casing containing a body of flare material. An elongated support element extends through the flare body along its central axis, and a truncated conical flame spreader is attached to one end of the support element with the smaller end of the truncated cone in firm engagement with an end surface of the flare body and with at least the major portion of the conical surface of the flame spreader recessed within an extended portion of the casing. A nose fairing is removably attached to the extended portion of the casing and is adapted to be blown away from the casing by a charge located in a cavity within the flame spreader. The charge is ignited by a fuse which extends through the hollow center of the support element, and when ignited the charge also operates to ignite the end surface of the flare body surrounding the flame spreader to cause a flame to be emitted outward from the opened end of the casing in the region between the extended portion thereof and the conical outer surface of the flame spreader acting as a flame deflection surface.

8 Claims, 4 Drawing Figures

Figure 1:
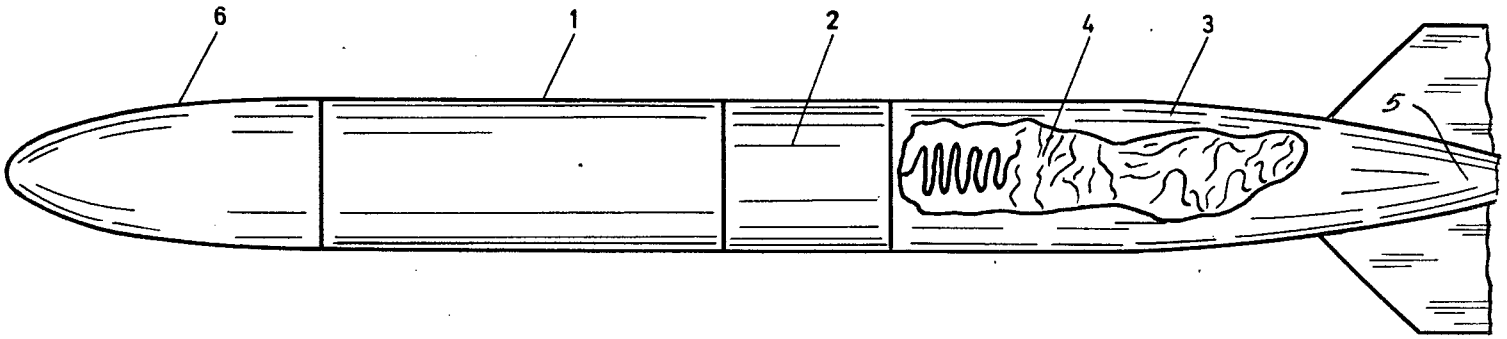

DEVICE FOR A PYROTECHNICAL FLARE BODY COMPRISING A FLAME SPREADER FOR THE FLAME EMITTED BY THE FLARE BODY

The present invention relates to flare bombs of the type employing a flare body which is adapted to be ignited after the bomb has been dropped with said flare body thereafter being suspended from a parachute, and is more particularly concerned with a device for use with such an arrangement wherein the pyrotechnical flare body is placed in a container and is intended to emit a flame directed outwards via an open end surface of the container. Said device comprises a flame spreader which supports one or more surfaces for deflecting the outwardly emitted flame.

Flame spreaders of this kind are known per se e.g. see Swedish patent 346.303. For ammunition of this kind, in order to achieve efficient production, it is highly desirable to combine several functions in the same units which, moreover, should have a simple design and be easy to assemble.

The present invention makes it possible to arrange the flame spreader on a central member extending through the flare body, for instance a tubular member, and at the same time said members are so shaped and positioned that the flame spreader operates to relieve the stresses acting one the flare body due to the retardation forces which are generated when the flare body is braked by means of an associated; parachute or parachutes. The flame spreader is, moreover, designed to also contain the charge utilized for blowing off the nose fairing of the bomb, missile etc. which carries the flare unit in question, and said charge is also used as for the ignition of the flare body in conjunction with said blowing off of the nose fairing.

Also from a functional point of vicar advantages are gained through the invention in that the flame spreader can be mounted at the open end surface of the container without special staying devices extending between the flame spreader and the container. This assures, particularly for flare bodies with diameters as large as 100 mm and more, which, in view of their large diameter, can be permitted to have one single deflected, unbroken flame from the flare body, that the flame is undisturbed by such staying devices and can pass between the inner surface of the container and the outer surface of the flame spreader (which serves as a deflection surface) which contributes towards stable light with high brilliancy being emitted from the flare body.

The feature that can mainly be considered to be characteristic, in accordance with the above, for a device according to the invention is thus that the flame spreader is located on a member extending centrally through the flare body in the longitudinal direction of said flare body. A flare bomb which achieves all the advantages discussed above will be described in the following, with reference to the accompanying drawings, in which FIG. 1 shows the design of the bomb, in principle, FIG. 2 in a vertical view and in cross-section shows the parts of FIG. 1 to which the invention relates, FIG. 3 in a vertical view and in cross-section shows a detail of FIG. 2 in a given functioning stage, and FIG. 4 in perspective, obliquely from below, depicts the flame which is emitted from the flare body in the functioning stage according to FIG. 3.

In the figures, parts corresponding to each other have been given the same reference designations.

The flare bomb according to FIG. 1 is composed of units known per se, and it thus supports a pyrotechnical flare body at the casing section indicated with the number 1 at the front parts of the bomb. Section 1 is fastened to a center part 2 which contains the fuze, safety devices, electric connections etc. To the center part is connected the tail assembly 3 of the bomb, which contains a main parachute 4 and a brake parachute 5 for the flare body. The bomb is also provided with a nose fairing 6.

In conjunction with the dropping of the bomb, the time fuze, not shown in detail, is started, and thereafter, in the order mentioned, the tail assembly 3 is blown off to uncover the parachutes 4 and 5, and the nose fairing 6 is blown away and the flare body is ignitied at its end surface in the direction away from the parachutes. When the main parachute has opened, the flare body, suspended from said parachute, will illuminate the area intended. These functioning processes are well known per se, and do not concern the actual invention.

Figure 2:
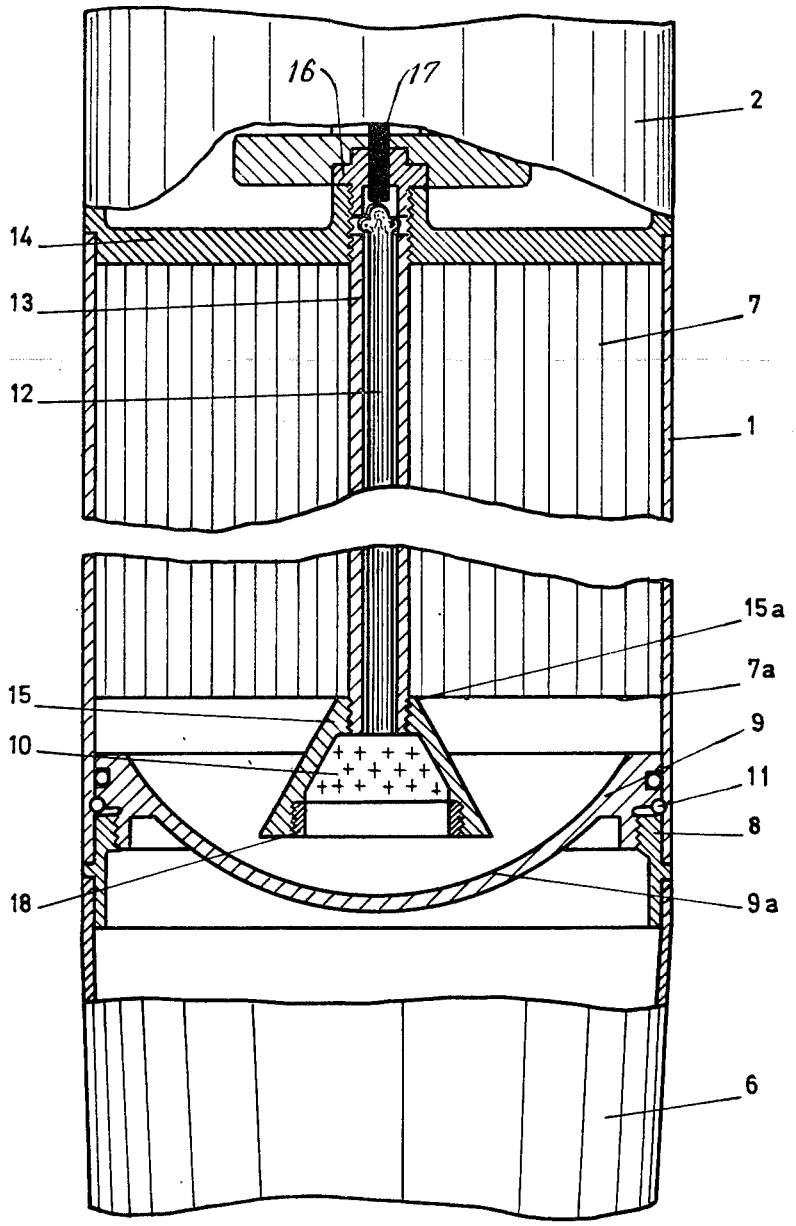

In FIG. 2, the center and front parts of the bomb are shown in more detail. The actual flare body is designated 7, and from the figure it will be noted that a part of the projectile body 1 also serves as a container for the flare casing. The nose fairing 6 is secured to the projectile body 1 or the container via a connecting part 8 which is pressed into one end of the container 1, the nose fairing 6 in turn, being pressed fast into the connecting part 8. Said pressing into place can be carried out in a way which is known in itself.

At said one end of the container or projectile body 1, behind the connecting part 8, a cap-formed expelling part 9 is placed, which has its cup-shaped inner surface 9*a* exposed to the gases from a separating charge 10. The expelling part 9 is secured in the container 1 via balls 11 (or, alternatively, a locking ring) which are placed in peripherally positioned recesses between the container 1 and the connecting part 8. When the separating charge 10 is initiated, the expelling part 9, the connecting part 8 and the nose fairing 6 are pressed outwards, so that the end surface 7*a* of the flare body 7 is uncovered.

The initiation of the charge 10 takes place from the center part 2 via a fuse 12 which in a way known in itself is inserted in a tube 13 extending centrally through the flare body 7 along its longitudinal axis and which has one of its ends screwed into a fastenting plate 14 associated with the center part 2, and which at its other end supports a flame spreader 15 which contains said charge 10. Said fastening plate 14 is made with a centrally positioned raised section which defines a threaded hole for the tube 13 so that the tube can be screwed in from one side of the plate 14 and a detonator 16 can be screwed into said hole from its other side. The detonator 16 is provided with a powder pellet 17 which is arranged so that its flame can ignite the fuse 12.

The flame spreader 15 is provided with a hub part which has an internally threaded hole, vai which the flame spreader 15 can be screwed onto corresponding threads at the other end of the tube 13. The outer contour of the flame spreader 15 has the form of a truncated cone, which has its small end surface 15a facing the surface 7a of the flare body. The threads on the flame spreader 15 and the tube 13 are chosen in such a way that the flame spreader 15 can be screwed on to the tube 13 so that the surface 15a will bear against parts of the surface 7a of flame body 7. The flare body will thereby be relieved via the flame spreader and the fuze of the stresses from the retardation forces imposed on the flare body when the parachutes open. The fastening of the flare body and the container 1 in the center part 2 can thereby be simplified considerably.

The flame spreader 15 defines a cavity which opens into the base of the truncated cone. The charge 10 is placed in said cavity, where it is held in place by an annular nut 18 or a corresponding part which is fastened in internal threads in the flame spreader.

The function of the parts described in FIG. 2 are as follows. When the fuze ignites the powder pellet 17 this, in turn, will ignite the fuse 12, which has a burining time of approx. 1 sec. After this time, the fuse 12 will ignite the charge 10 which, via the part 9, expels the connecting part 8 and the nose fairing 6. The expulsion gases, which pass through the opening in the nut 18 also ignite the surface 7*a* of the flare body.

Figure 3:
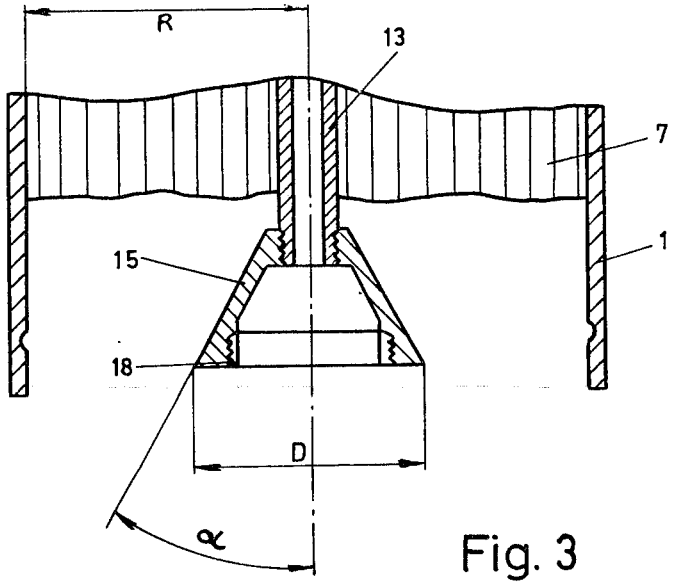
Figure 4:
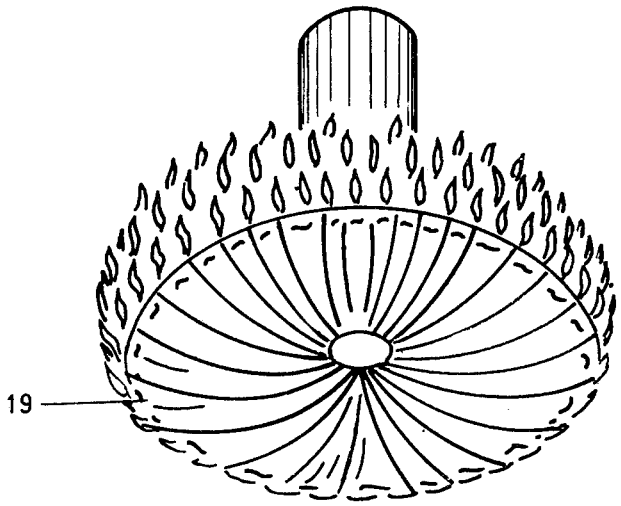

FIG. 3 shows the stage after the parts 8 and 9 and the nose fairing 6 have been blown away, and for the sake of clearness, the form of the flame 19 in the functioning stage corresponding to FIG. 3 has been shown spearately in FIG. 4. In the illustrated embodiment of the invention, the flare body 7 is comparatively large and has a diameter of 190 mm or $R \approx 95$ mm. The truncated cone 15 has a base surface diameter D which substantially corresponds to the radius R of the flare body, and the angle of inclination $\alpha$ of the envelope surface of the cone is approx. 30°. Further, the length of the container 1 is so chosen relative to the surface 7*a* of flare body 7 that the entire deflection surface of the flame spreader or the envelope surface of the truncated cone is completely recessed into the container. An essential characteristic of the invention is that at least the major portion of the deflection surface of the flame spreader is retracted into or recessed within the container.

By reason of the shape and positioning of the flame spreader 15, a deflected and unbroken flame is obtained from the flare body 7, which can pass freely between the inner wall of the container 1 and the envelope surface of the truncated cone.

The invention is not limited to the embodiment shown in the above as an example, but can also be subject to modifications within the scope of the following claims. Thus, the number of deflection surfaces of the flame spreader and the inclinations of these can be varied, and moreover the tube 13 can be provided with special supporting members which make it particularly resistant to the heat developed by the flare body.

We claim:

1. In a pyrotechnical device of the type comprising a cylindrical container having an elongated cylindrical flare body therein, one end of said container being open to emit an outwardly directed flame from said container upon ignition of an ignitable end surface of said flare body that is disposed adjacent to the open end of said container, the improvement comprising an elongated support element embedded within said flare body at a central location therein and extending along the central axis of said cylindrical container and flare body completely through said flare body in the direction of elongation of said body, and a flame spreader attached to one end of said support element at a position adjacent to said ignitable end surface of said flare body, said flame spreader having at least one flame deflection surface disposed at a central location relative to said ignitable end surface for controlling the emission of said outwardly directed flame from said end surface in the region between said flame deflection surface and the sides of said continer, the side walls of said container adjacent the pen end of said container extending beyond said ignitable surface of said flare body and beyond at least a major portion of said flame deflection surface, said flame spreader being shaped substantially as a truncated cone coaxial with said support element and being positioned with the smaller end of said truncated cone located adjacent to said ignitable surface of said flare body, the outer conical surface of said truncated cone acting as said flame deflection surface, said outer conical surface being freely spaced from the cylindrical side walls of said container that extend beyond said ignitable surface of said flare body to permit said outwardly directed flame to pass freely therebetween.

2. The device of claim 1 wherein the diameter of the larger end of said truncated cone is substantially equal to the radius of said cylindrical flare body.

3. The device of claim 1 wherein said flame spreader defines an internal cavity opening into the larger end of said truncated cone, an ignitable charge in said cavity, means for selectively igniting said charge, and a cup-shaped element disposed in spaced facing relation to the larger end of said truncated cone for directing gasses, issuing from said cavity opening upon ignition of said charge, toward said ignitable surface of said flare body to effect ignition of said flare body.

4. The device of claim 3 wherein said support element includes an interior channel communicating with said cavity in said truncated cone, said means for selectively igniting said charge being at least partially located within said channel.

5. The device of claim 1 wherein said container and flare body comprise portions of a projectile, said one end of said support element being threaded, said flame spreader including a threaded mounting portion in thread engagement with said one end of said support element, said smaller end of said flame spreader firmly engaging said ignitable end surface of said flare body to relieve mechanical stresses arising in said flare body when said projectile decelerates.

6. The device of claim 5 including a plate extending across the end surface of said flare body that is remote from the open end of said container, the other end of said support element being fastened to said plate.

7. The device of claim 5 wherein said projectile includes a nose fairing removably connected to said container adjacent said open end of said container, parachute means in said projectile attached to the other end of said container, said flame spreader including a cavity having an ignitable charge therein for blowing away said nose fairing to expose the open end of said container and for igniting said end surface of said flare body to cause said outwardly directed flame to be emitted from the lower end of said container when said container is suspended from said parachute means, said elongated support element comprising a hollow tubular element opening into said cavity and containing an elongated fuse one end of which is disposed adjacent said charge, and detonator means adjacent the other end of said hollow tubular element for selectively igniting the other end of said fuse thereby to effect ignition of said charge after a predetermined time delay.

8. The device of claim 7 wherein said projectile includes an expelling element responsive to the pressure of gases generated upon ignition of said charge for disconnecting said nose fairing from said container, said expelling element including a surface shaped and positioned to direct said gases toward said ignitable end surface of flare body to ignite said flare body.

* * * * *